US007478814B2

(12) United States Patent
Foley et al.

(10) Patent No.: US 7,478,814 B2
(45) Date of Patent: Jan. 20, 2009

(54) GAME HAVING SHREDDER FOR OPERATION BY CHILDREN

(75) Inventors: Charles F. Foley, Park Rapids, MN (US); Daniel Lee Bizzell, Davidson, NC (US); Ryan S. Gorman, Charlotte, NC (US); Ronald W. Randle, Huntersville, NC (US); Jason A. Gammon, Charlotte, NC (US); Todd S. Stancombe, Charlotte, NC (US)

(73) Assignee: Edison Nation, LLC, Charlotte, NC (US)

( * ) Notice: Subject to any disclaimer, the term of this patent is extended or adjusted under 35 U.S.C. 154(b) by 0 days.

(21) Appl. No.: 11/765,413

(22) Filed: Jun. 19, 2007

(65) Prior Publication Data

US 2008/0042350 A1 Feb. 21, 2008

Related U.S. Application Data

(60) Provisional application No. 60/805,180, filed on Jun. 19, 2006.

(51) Int. Cl.
*A63F 3/00* (2006.01)

(52) U.S. Cl. ..... 273/243; 273/153 R

(58) Field of Classification Search ..... 273/242, 273/243, 306, 153 R; 434/128, 129
See application file for complete search history.

(56) References Cited

U.S. PATENT DOCUMENTS 6,425,581 B1 * 7/2002 Barrett ..... 273/157 R
6,663,732 B1 * 12/2003 Link ..... 156/63

* cited by examiner

*Primary Examiner*—Vishu K. Mendiratta
(74) *Attorney, Agent, or Firm*—Tillman Wright, PLLC; Chad D. Tillman; James D. Wright

(57) ABSTRACT

A game includes a game board, a paper shredder; and a plurality of shreddable cards having various visually-identifiable indicia. The game board, the paper shredder and the shreddable cards are arranged in a box. A method of playing the game includes shredding a first of the plurality of cards; receiving, by a player, the shredded pieces of the first card; attempting to identify the visually-identifiable indicia depicted on a first side of the first card; and controlling game play, on the game board, based on the success of the step of attempting to identify the visually-identifiable indicia depicted on the first card.

19 Claims, 9 Drawing Sheets

14

18

14

14

GAME HAVING SHREDDER FOR OPERATION BY CHILDREN

I. CROSS-REFERENCE TO RELATED APPLICATION

The present application is a U.S. nonprovisional patent application of, and claims priority under 35 U.S.C. §119(e) to, U.S. provisional patent application Ser. No. 60/805,180, filed Jun. 19, 2006, which provisional patent application is incorporated by reference herein.

II. COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

III. BACKGROUND OF THE INVENTION

Children are often interested in mechanical devices that are primarily used by adults. In particular, children are often fascinated with shredding devices used by adults for shredding household papers such as bills or bank statements. Often role-play versions of such devices are offered by manufacturers for children to pretend to use. However, many times children are not appeased by such devices. It is believed that children would find a safe, play version of such devices, in particular a shredding device, very appealing In addition, children of various ages enjoy puzzles and enjoy playing board games wherein they compete against one another. A children's game combining a child-safe shredding device with puzzle play and competition would be very appealing to children of varying ages.

IV. SUMMARY OF THE INVENTION

The present invention includes many aspects and features.

In a first aspect of the present invention, a method of playing a game comprises the steps of providing a game board having depicted thereon a path of spaces along which one or more tokens may be moved; providing a paper shredder; providing a plurality of cards upon which are depicted various visually-identifiable indicia; shredding a first of the plurality of cards; receiving, by a player, the shredded pieces of the first card; attempting to identify the visually-identifiable indicia depicted on a first side of the first card; and controlling game play, on the game board, based the on success of the step of attempting to identify the visually-identifiable indicia depicted on the first card.

In a feature of this aspect, a player is a single person. In another feature, a player is a team of people.

In an additional feature of this aspect, the method further comprises determining a first player to start the game. In accordance with this feature, determining a first player to start the game is done by each player of a plurality of players flipping an item to determine the first player. Further in accordance with this feature, the item is a medallion. With regard to this feature, determining a first player to start the game is done by each player of a plurality of players utilizing a random number generator to determine which player is the first player. It is preferred that the random number generator is a spinner with numbers increasing sequentially in value and the player spinning the highest number on the spinner is the first player.

In another feature of this aspect, controlling game play includes determining a number of spaces a player will be eligible to move. In accordance with this feature, determining a number of spaces a player will be eligible to move is done using a random number generator. It is preferred that the random number generator is a spinner having numbers increasing sequentially disposed thereon. Alternatively, it is preferred that the random number generator is a spinner having two levels of action indicators disposed thereon. With regard to this feature, a first level of action indicators includes numbers increasing sequentially. With further regard to this feature, the second level of action indicators includes color coding. Alternatively, the second level of action indicators includes letters arranged alphabetically. In accordance with this feature, determining a number of spaces a player will be eligible to move is determined by a number disposed on a second side of the first card.

In yet another feature, providing a plurality of cards includes providing a plurality of cards having visually-identifiable indicia of a uniform difficulty level. In an additional feature, providing a plurality of cards includes providing a plurality of cards having visually-identifiable indicia of multiple difficulty levels. In a further feature, providing a plurality of cards includes providing a plurality of stacks of playing cards, with each stack of the plurality of stacks of playing cards being assigned a predetermined difficulty level and each card within a particular stack having a visually-identifiable indicia commensurate with the difficulty level of that particular stack. With regard to this feature, the plurality of stacks of playing cards is three stacks, the three stacks signifying low, intermediate and challenging difficulty levels.

In an additional feature, the visually-identifiable indicia include images of easily-recognizable objects. In a further feature, the visually-identifiable indicia include text spelling out easily-recognizable words or phrases. In another feature, the method further comprises the step of providing a timer for limiting the duration of the step of attempting to identify the visually-identifiable indicia depicted on a first side of the first card. It is preferred that the timer is a sand timer.

In another feature, the paper shredder is housed in a shredding device that is shaped as a stylized depiction of an animal. It is preferred that the paper shredder is housed in a shredding device that is shaped as a stylized depiction of a dog.

In yet another feature, the game board includes a plurality of element spaces having information associated there with, said element spaces being disposed on the game board, whereby if a player encounters an element space during game play, the player may have to move forward or backward on the game board depending on the information associated with said element space.

In another aspect of the invention, a method of playing a game comprises the steps of: (a) providing pieces for playing the game, said game pieces including a board having a predetermined number of spaces thereon; a random number generator; a collection of playing cards, each card having an image or phrase located thereon; a shredding device and a timer; (b) determining a first player to start the game; (c) determining a number of spaces the first player will be eligible to move; (d) a second player choosing a playing card from the collection of cards; (e) the second player placing the chosen card face down into the shredding device; (f) removing a shredded card from the shredding device; (g) after the shredded card is removed from the shredding device, starting the timer; (h) the first player attempting to determine the image or phrase that was on the card prior to its being shredded in the allotted time; (i) if the first player correctly identifies the image or phrase, the first player moving forward the number of determined spaces; (j) the second player repeating steps (c)-(i), with another player assisting, and (k) repeating steps (c)-(i) for each player in the game until a player reaches a last space on the game board.

In a feature of this aspect, a player is a single person. In another feature of this aspect, a player is a team of people.

In an additional feature of this aspect, determining a first player to start the game is done by each player of a plurality of players flipping an item to determine the first player. It is preferred that the item is a medallion.

In yet another feature, determining a first player to start the game is done by each player of a plurality of players utilizing a random number generator to determine which player is the first player. In accordance with this feature, the random number generator is a spinner with numbers increasing sequentially in value and the player spinning the highest number on the spinner is the first player. Further in accordance with this feature, determining a number of spaces the first player will be eligible to move is done by a first player utilizing a random number generator. With regard to this feature, the random number generator is a spinner having numbers increasing sequentially disposed thereon. It is preferred that the random number generator is a spinner having two levels of action indicators disposed thereon. With regard to this feature, a first level of action indicators includes numbers increasing sequentially. With further regard to this feature, the second level of action indicators includes color coding. Alternatively, the second level of action indicators includes letters arranged alphabetically.

In another feature, steps (c) and (d) are combined into one step and the number of spaces the first player will be eligible to move is determined by a number disposed on a second side of the selected playing card. In an additional feature, the collection of playing cards includes cards having images and phrases of a uniform difficulty level. In yet another feature, the collection of playing cards includes cards having images and phrase of multiple difficulty levels. In a further feature, the collection of playing cards is a plurality of stacks of playing cards, with each stack of the plurality of stacks of playing cards being assigned a predetermined difficulty level and each card within a particular stack having an image or phrase commensurate with the difficulty level of that particular stack. It is preferred that the plurality of stacks of playing cards is three stacks, the three stacks signifying low, intermediate and challenging difficulty levels.

In a further feature, the timer is a sand timer. In another feature, the shredding device is shaped as a stylized depiction of an animal. It is preferred that the shredding device is shaped as a stylized depiction of a dog.

In an additional feature, the game board includes a plurality of element spaces having information associated there with, said element spaces being disposed on the game board, whereby if a player encounters an element space during game play, the player may have to move forward or backward on the game board depending on the information associated with said element space.

In an additional aspect of the invention, a game comprises a game board; a paper shredder; and a plurality of shreddable cards having various visually-identifiable indicia. The game board, the paper shredder and the shreddable cards are arranged in a box.

In addition to the aforementioned aspects and features of the present invention, it should be noted that the present invention further includes the various possible combinations of such aspects and features.

V. BRIEF DESCRIPTION OF THE DRAWINGS

One or more embodiments of the present invention will be described in detail with reference to the accompanying drawings which are briefly described below, and wherein the same elements are referred to with the same reference numerals.

VI. DETAILED DESCRIPTION

Figure 1:
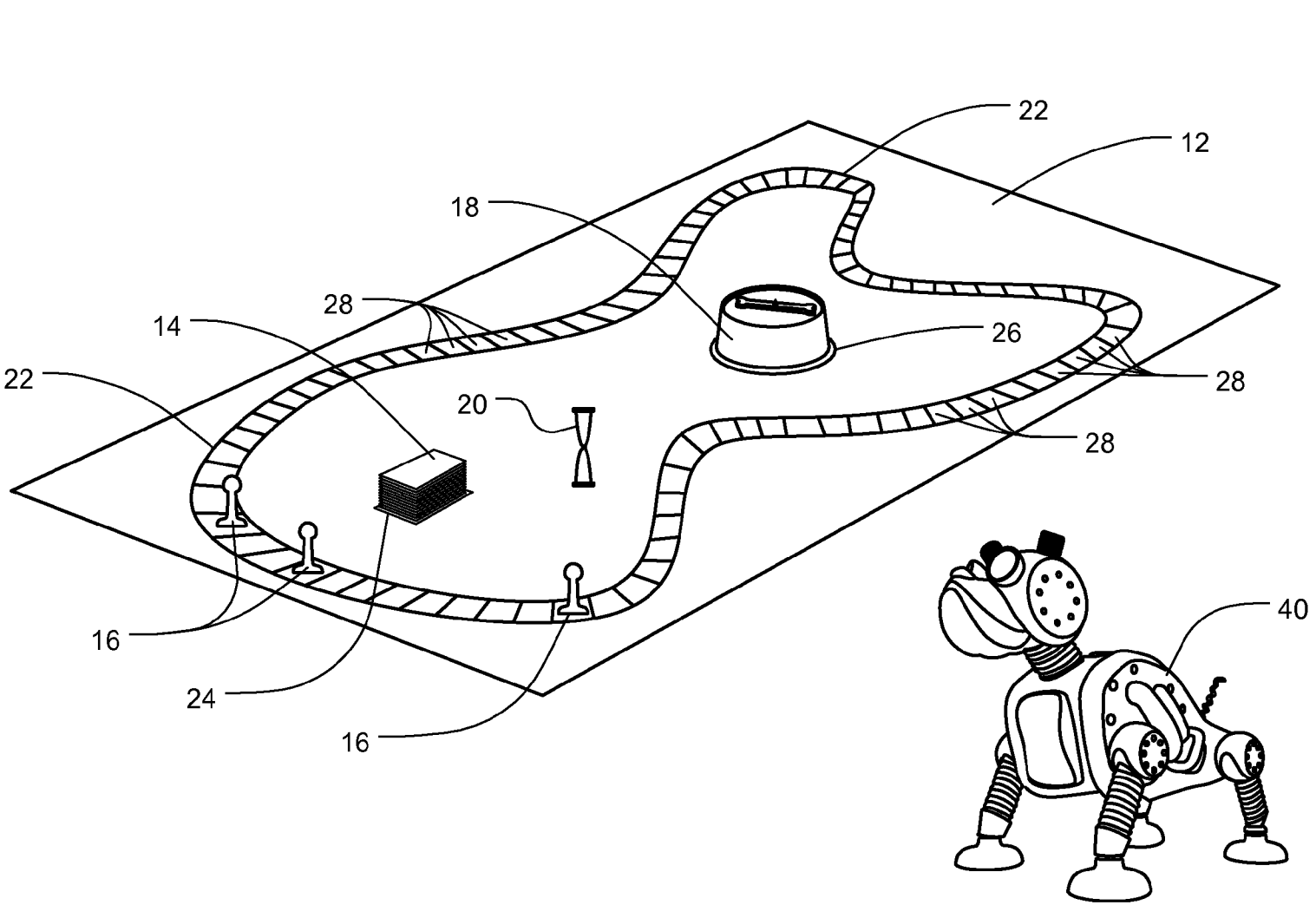
FIG. 1 is a perspective view of the pieces of a shredded paper puzzle game in accordance with the preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, the preferred embodiments of the present invention are next described. The following description of the preferred embodiment(s) is merely exemplary in nature and is in no way intended to limit the invention, its application, or uses.

FIG. 1 is a perspective view of the pieces of a shredded paper puzzle game 10 in accordance with the preferred embodiments of the present invention. In a preferred embodiment, the game 10 includes a board 12, a collection of cards 14, a token 16 for each player, a random number generator 18, a timer 20 and a paper shredding device 40, and may also include written background materials and instructions (not shown) for playing the game 10. In order to improve visual appeal, interest and the like, some or all of the elements of the game 10 invoke a desired, predetermined theme. In particular, it is currently anticipated that the assignee of the present invention may market the game 10 using a "scary dog" theme, wherein the dog is nicknamed "Shredder."

The board 12 includes a play area 22 as well as areas 24, 26 for storing a stack or stacks of cards 14 and the random number generator 18. The play area 22 includes a circular path or sequence of playing spaces 28. Optionally, the playing spaces 28 may be of different types, which may be denoted with different colors, labels, decorations, images, or the like, or a combination thereof. In a preferred embodiment, the path 22 includes at least two different types of spaces 28: normal spaces and special element spaces. The special element spaces are generally associated with a consequential action, i.e., a player having to move forward or backward in game play depending on the consequential action associated with the element space. For the theme wherein the shredding device 40 is a scary dog, exemplary element spaces may include that a dog ate a child's homework or that a storm came and washed away the dog bowl. Preferably, the various elements of the board 12 carry out the same theme as described previously. Further, instructions may be printed on the front or back of the board 12, on a separate sheet of paper, or the like.

As shown, the tokens 16 may be small conventional tokens of different colors, but may generally be any objects of different colors, shapes or the like that are small enough to fit comfortably on the spaces 28 of the board 12, heavy enough not to be easily blown or shaken off the board 12, and easily distinguishable from the other tokens 16. Although not shown, the tokens 16 preferably invoke the same theme as described previously.

Figure 2:
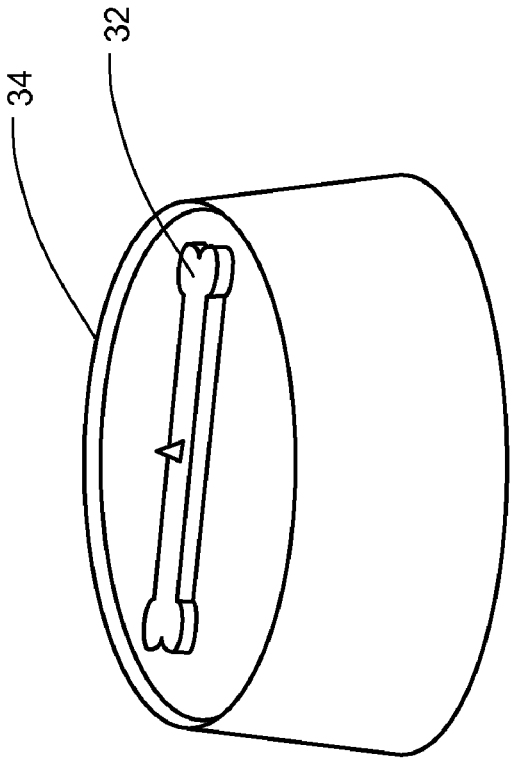
FIG. 2 is an enlarged perspective view of the spinner of FIG. 1.

The random number generator 18 is preferably a spinner that may be generally conventional in function but which also invokes the theme described previously. In particular, a spinner 18 suitable for use with the "scary dog" theme may be a dog bone 32 rotatably disposed in a dog bowl 34, wherein the dog bone 32 provides the pointer to the various possible outcomes shown in the dog bowl 34. Such a device is shown in FIG. 2, which is an enlarged perspective view of the spinner 18 of FIG. 1. Alternatively, the spinner 18 may be a multi-level spinner that generates more than just a single random number. For example, the spinner 18 may also be color coded or may generate multiple random numbers. Alternatively, however, the random number generator 18 may be a die or any other device capable of generating small random whole numbers.

Figure 3:
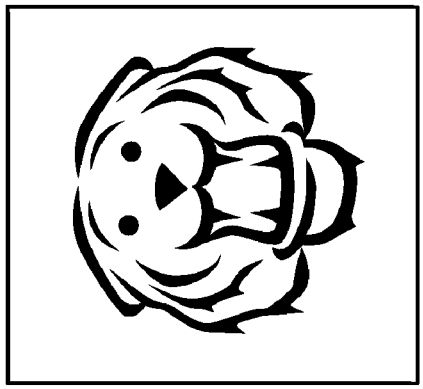
FIG. 3 is a front plan view of an exemplary one of the cards of FIG. 1.

The cards 14 are one of the unique aspects of the game 10. One side or face may carry indicia invoking the theme of the game 10 as described previously, but the opposite face has printed thereon an image or a small amount of text. Text is preferably printed in a large, easy-to-read font, and forms simple words or phrases that may be easily recognized by an appropriate age group of children. Images are preferably simple line drawings of bold, easy-to-recognize objects. In either case, the printing preferably uses clear, black or dark-colored ink on a white or light-colored background, though neither is a requirement. FIG. 3 is a front plan view of an exemplary one of the cards 14 of FIG. 1, illustrating these desired attributes. In one or more embodiments, the cards 14 may be divided into several different sets based on level of difficulty and/or theme. Also in one or more embodiments, the text or images on the cards 14 may provide educational value. Alternatively, in one or more embodiments, the face of the card 14 opposite the face having the image or text printed thereon may have a number printed thereon indicating the difficulty level of the card 14.

Figure 4:
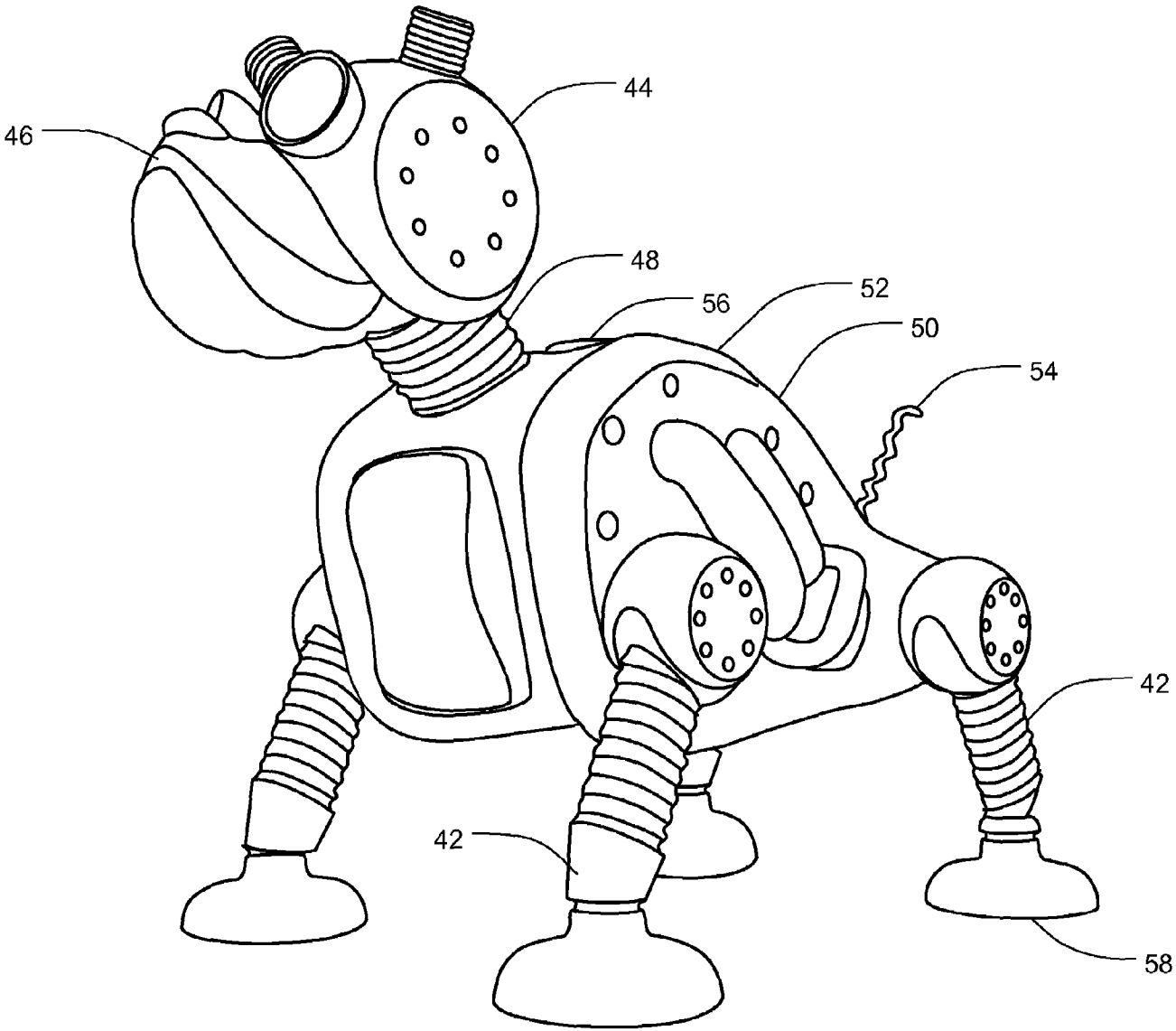
FIG. 4 is a perspective view of the shredder device of FIG. 1.
Figure 5:
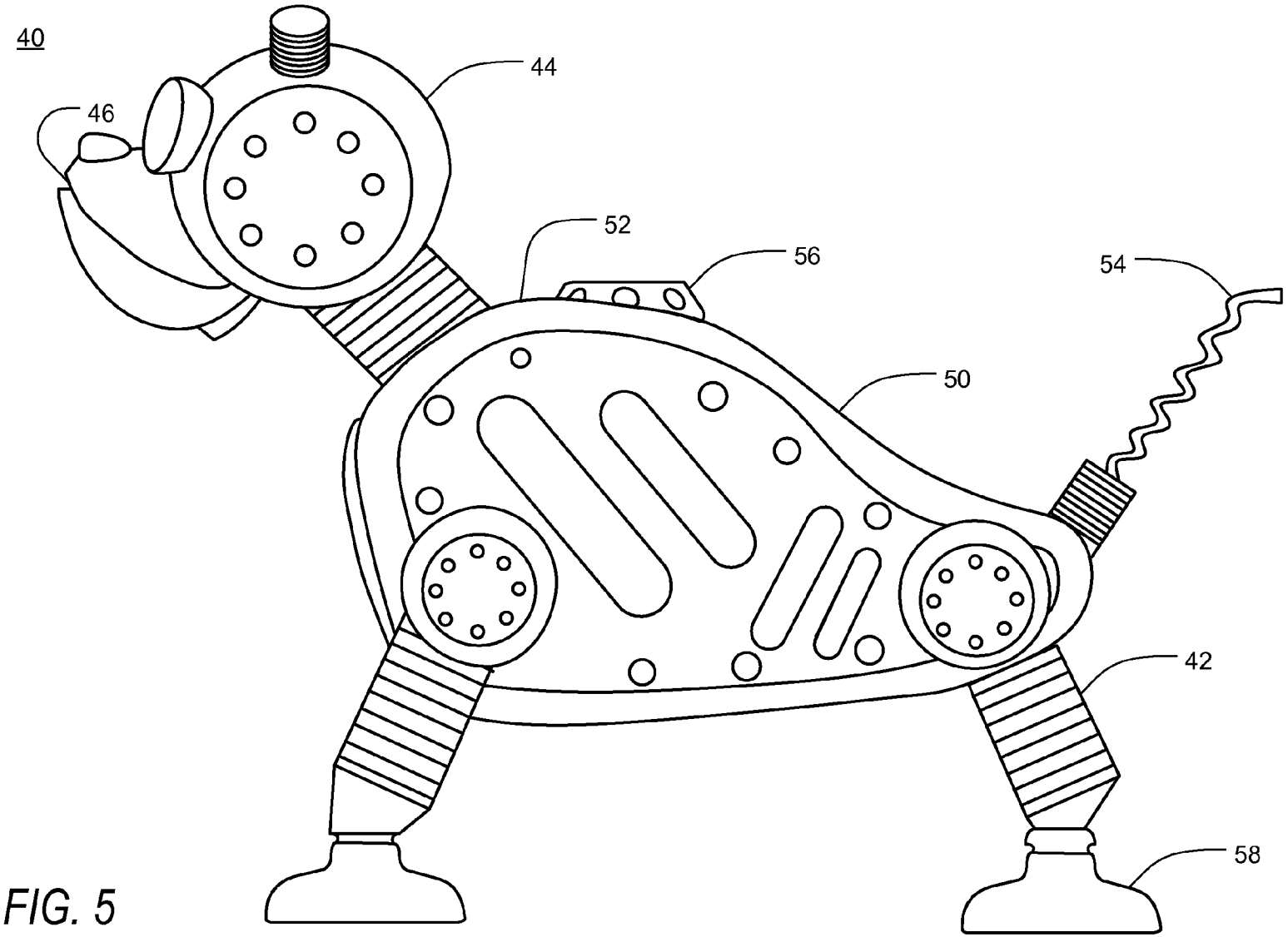
FIG. 5 is a side view of the shredder device of FIG. 1.

FIG. 4 is a perspective view of the shredder device 40 of FIG. 1, and FIG. 5 is a side view of the shredder device 40 of FIG. 1. Following the previously described scary dog theme, the shredder device 40 is in the shape of a dog. It has four legs 42, a head 44 with a mouth 46 and neck 48, a body 50 with a back 52 and a tail 54. In addition to the external design elements, the shredder device 40 further includes a paper shredder (not shown), which may be of conventional design, disposed within the interior of the device 40. When using the shredding device 40 for game play, it is contemplated that a card 14 will be inserted face down into an opening in the base of the dog's neck 48 or the dog's back 52 to be shredded. It is also contemplated that the shredded card 14 will pass through the internal paper shredder before being dispensed out of the dog's mouth 46 when shredding is complete. Of course, other routings may be substituted as desired and using appropriate guides and the like to help move the card 14 through the paper shredder and out. In addition, in a preferred embodiment, a dial 56 is disposed on the dog's back. The dial 56 controls the speed of the shredder. In addition, the shredding device 40 includes suction feet 58 disposed at terminal ends of the four legs 42. The suction feet 58 secure the shredding device 40 to a surface on which it is placed, generally a table.

Figure 6:
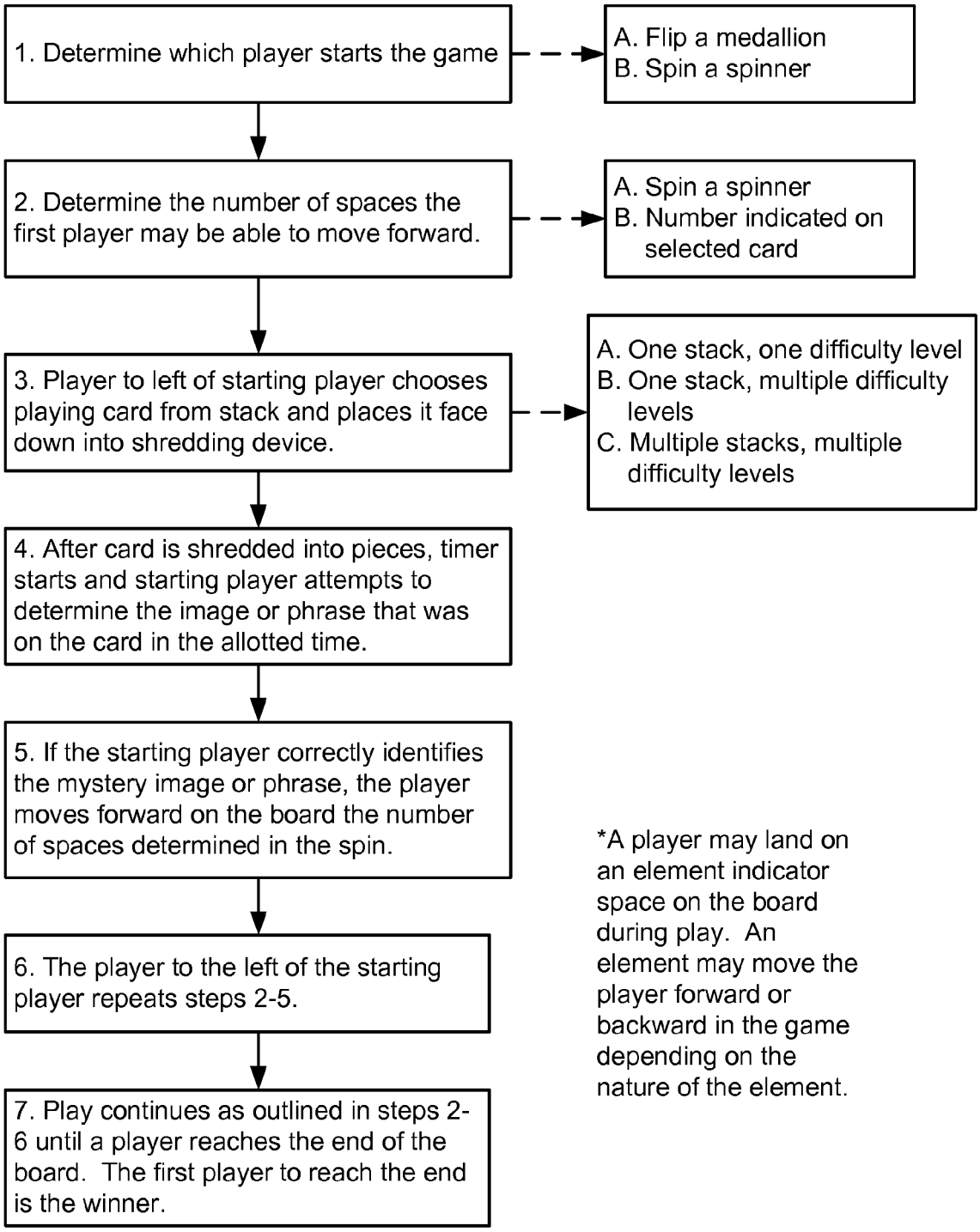
FIG. 6 is a flow diagram illustrating an overall view of how the game of FIG. 1 may be played.

FIG. 6 is a flow diagram illustrating an overall view of how the game 10 may be played. The game 10 may be best played by at least two and no more than six players, but the game 10 may also have value (such as a puzzle or challenge) for a single player playing alone, or by larger numbers of players, particularly if modifications are made to the primary preferred embodiment described and illustrated herein to accommodate additional players. In addition, it is contemplated that the game 10 may be played by single individuals competing against one another or may be played by teams of individuals competing against one another. Before play may begin, the cards 14 should be organized and may be shuffled if desired and then placed in the designated location 24 on the game board 12. A token 16 is assigned to each player and placed on a designated "Start" space (not shown) along the path 22 of the board 12. If there are multiple players, then the starting player may be chosen by first spinning the spinner 18 or by some other conventional means. An alternative means for determining a starting player involves the players flipping a medallion to determine which player starts the game 10. For the theme wherein the shredding device 40 is a dog, the medallion may be a dog collar tag having an image of a dog's head on one side and having an image of a dog's tail on the other side. The player that wins the coin toss, or in this instance, the medallion toss, starts the game 10 first. This method of determining a first player is optimally used when the game 10 is being played by two players. Play moves in a clockwise direction, with the player to the left of the starting player taking a turn after the starting player's turn is over.

Multiple methods of game play are contemplated. Three such contemplated game play methods will be described herein. However, the Ordinary Artisan will understand that there are numerous additional game play methods that may be utilized.

Figure 7:
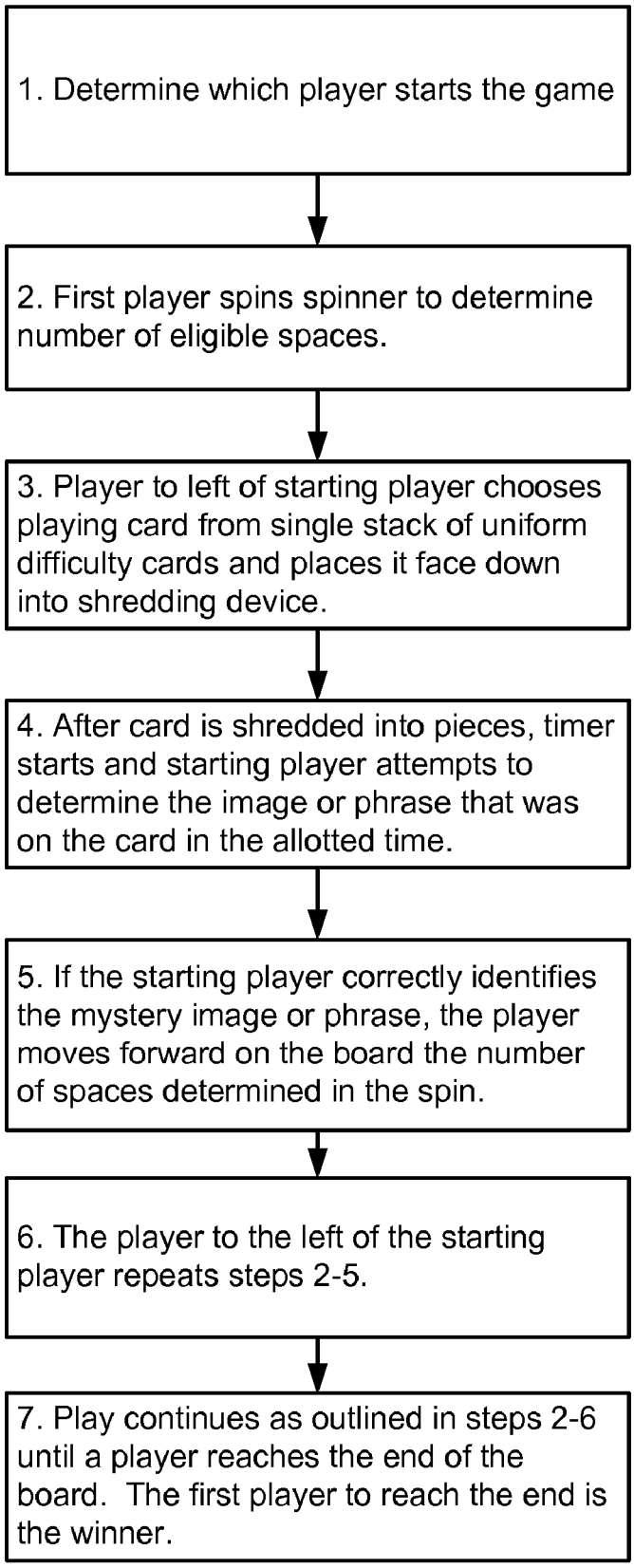
FIG. 7 is a flow diagram illustrating the steps for playing the game according to a first contemplated game playing method.

FIG. 7 is a flow diagram illustrating the steps for playing the game 10 according to a first contemplated game playing method. The player that has been determined to be the starting player begins the game 10 by operating the spinner 18. The starting player or first player spins the spinner 18 to determine the number of spaces 28 that the first player will be eligible to move forward. The number that the first player lands on with the spinner 18 may also indicates the speed of the shredder. Once the first player has spun, the player to the left of the first player, the second player, chooses a card 14 from the stack and places it face down into the shredding device 40. The second player ensures that the first player does not see the image or phrase disposed on the card 14 prior to putting it in the shredding device 40. Once the card 14 exits the shredding device 40, the timer 20 is begun. The first player has the time allotted by the timer 20 to determine the image or phrase that was on the card 14 prior to its being shredded. If the player is able to figure out the image or phrase, then the player is able to advance the number of spaces 28 previously determined by the spinner 18. If the player does not figure out the shredded image or phrase, the player remains in the present space. Regardless of whether the first player determines the image or phrase, the first player's turn is over when the timer 20 expires.

Figure 9:
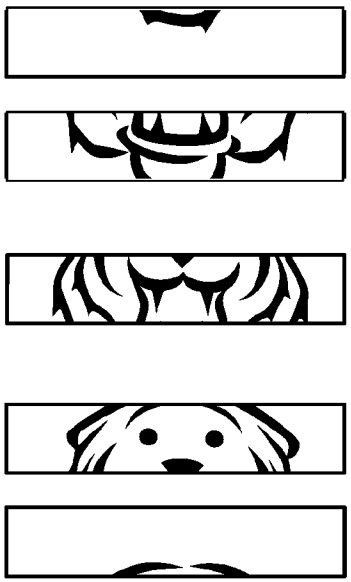
FIG. 9 is a front plan view of the various pieces of the shredded card of FIG. 8, shown after the pieces have been rearranged.
Figure 8:
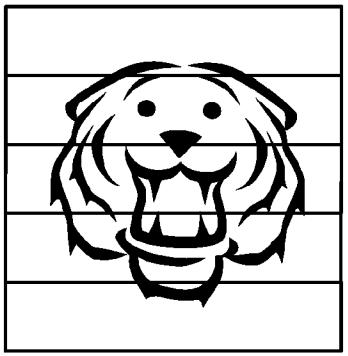
FIG. 8 is a front plan view of the exemplary card of FIG. 3, shown after the shredder has cut it into five pieces.

FIG. 8 is a front plan view of the exemplary card 14 of FIG. 3, shown after the shredder has cut it into five pieces. Of course, different numbers and shapes of pieces may alternatively be used. FIG. 9 is a front plan view of the various pieces of the shredded card 14 of FIG. 8, shown after the pieces have been rearranged. The general object is to organize the pieces back into the proper arrangement in order to make it easier to guess the image shown thereon.

When the first player's turn is over, play moves to the second player. The second player begins by spinning the spinner 18. Once the number of spaces 28 that the second player will be eligible to advance is determined, a third player selects a card 14 and places it face down in the shredding device 40. If there are only two players, the first player will perform the actions that a third player would perform Once the card 14 exits the shredding device 40, the timer 20 begins, and the second player has the allotted time to determine the image or phrase the was on the card 14 prior to its being shredded. If the second player is able to determine the shredded image or phrase, the second player may advance the number of spaces 28 previously determined. If not, the second player remains at the space where the second player is presently located. Once the timer 20 expires, the second player's turn is over and play moves to a third player, or alternatively, back to the first player. Play continues in this manner until a player reaches the last space on the board 12. The player that first reaches the last space on the board 12 is the winner.

Figure 10:
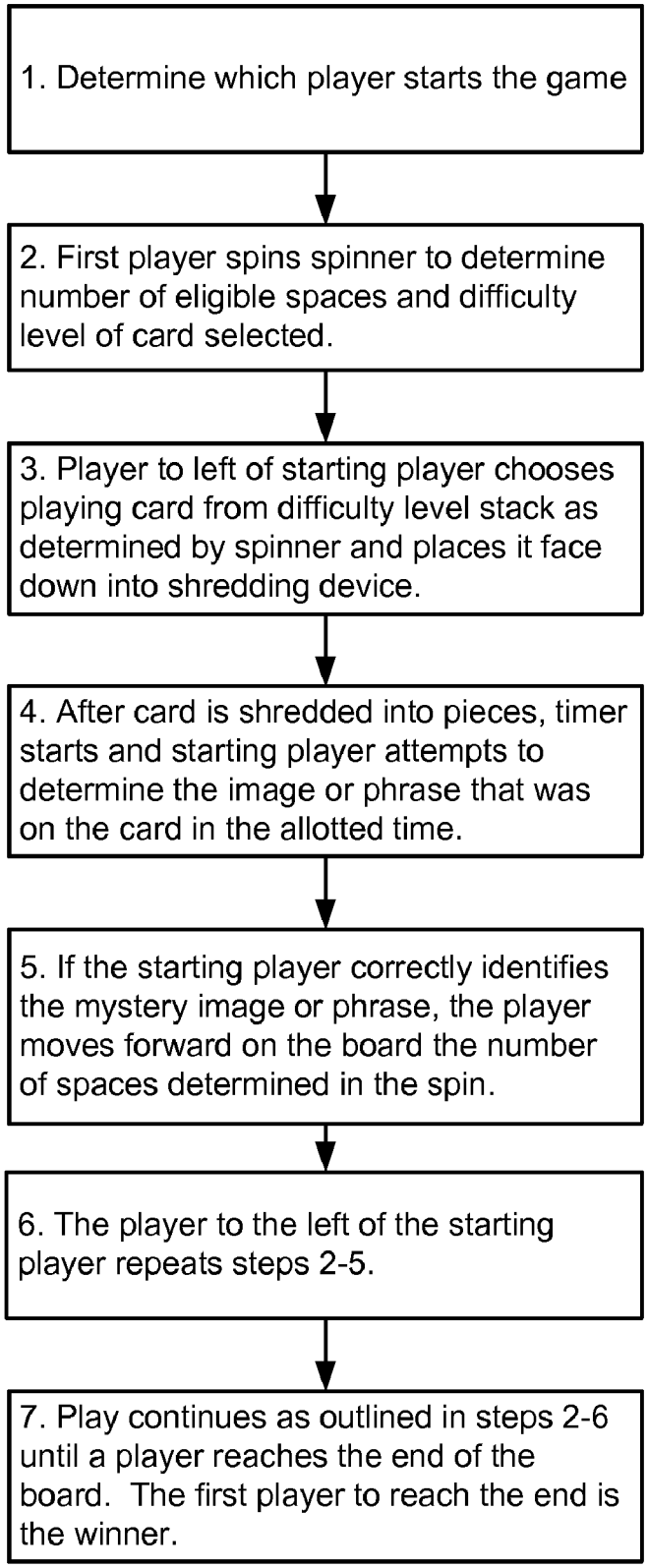
FIG. 10 is a flow diagram illustrating the steps for playing the game 10 according to a first contemplated game playing method.

FIG. 10 is a flow diagram illustrating the steps for playing the game 10 according to a second contemplated game playing method. In a second method, the first player begins by utilizing a spinner 18 to determine the number of spaces 28 that the first player will be eligible to move forward. It is preferred that the spinner 18 in this alternative method be a dual level spinner 18 that indicates the level of difficulty of the card 14 to be selected in addition to indicating the number of spaces 28 a player will be eligible to move forward. In this contemplated method of the game 10, there are preferably three stacks of cards 14 signifying three levels of difficulty. After the first player spins, a second player selects a card 14 from the appropriate stack of cards 14 and places it face down in the shredding device 40. The second player ensures that the first player does not see the image or phrase disposed on the card 14 prior to putting it in the shredding device 40.

Once the card 14 exits the shredding device 40, the timer 20 is begun. The first player has the time allotted by the timer 20 to determine the image or phrase that was on the card 14 prior to its being shredded. If the player is able to figure out the image or phrase, then the player is able to advance the number of spaces 28 previously determined by the spinner 18. If the player does not figure out the shredded image or phrase, the player remains in the present space. Regardless of whether the first player determines the image or phrase, the first player's turn is over when the timer 20 expires.

When the first player's turn is over, play moves to the second player. The second player begins by spinning the spinner 18. Once the number of spaces 28 that the second player will be eligible to advance and the difficulty level of the card 14 to be selected are determined, a third player selects a card 14 from the appropriate stack and places it face down in the shredding device 40. If there are only two players, the first player will perform the actions that a third player would perform Once the card 14 exits the shredding device 40, the timer 20 begins, and the second player has the allotted time to determine the image or phrase the was on the card 14 prior to its being shredded. If the second player is able to determine the shredded image or phrase, the second player may advance the number of spaces 28 previously determined. If not, the second player remains at the space where the second player is presently located. Once the timer 20 expires, the second player's turn is over and play moves to a third player, or alternatively, back to the first player. Play continues in this manner until a player reaches the last space on the board 12. The player that first reaches the last space on the board 12 is the winner.

Figure 11:
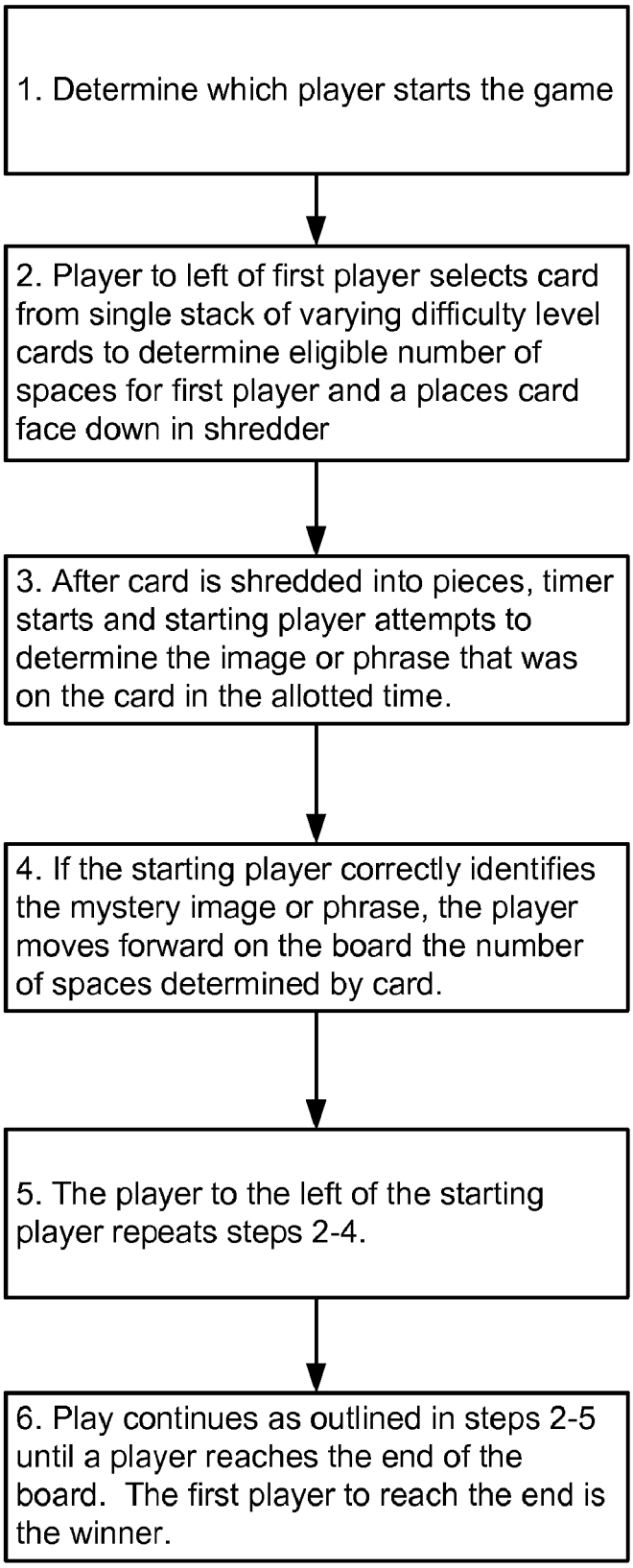
FIG. 11 is a flow diagram illustrating the steps for playing the game 10 according to a first contemplated game playing method.

FIG. 11 is a flow diagram illustrating the steps for playing the game 10 according to a third contemplated game playing method. In a third method, the game 10 is played with cards 14 that are of varying difficulty levels but that are placed in a single stack together. The cards 14 have a number disposed on a second side thereof that indicates the level of difficulty of the image or phrase disposed on a first side of the card 14.

Once the first player is determined, a second player selects a card 14 from a randomly ordered stack of cards 14. A number on the second side of the card 14 indicates the difficulty level of the card 14 as well as the number of spaces 28 the first player will be eligible to move if the first player correctly identifies the image or phrase on the shredded card 14. The second player places the selected card 14 face down into the shredding device 40.

Once the card 14 exits the shredding device 40, the timer 20 is begun. The first player has the time allotted by the timer 20 to determine the image or phrase that was on the card 14 prior to its being shredded. If the player is able to figure out the image or phrase, then the player is able to advance the number of spaces 28 indicated on the card 14. If the player does not figure out the shredded image or phrase, the player remains in the present space. Regardless of whether the first player determines the image or phrase, the first player's turn is over when the timer 20 expires.

When the first player's turn is over, play moves to the second player. A third player selects a card 14 from the stack of cards. The number on the second side of the selected card 14 determines the number of spaces 28 the second player will be eligible to move. The third player places the selected card 14 face down in the shredding device 40. If there are only two players, the first player will perform the actions that a third player would perform Once the card 14 exits the shredding device 40, the timer 20 begins, and the second player has the allotted time to determine the image or phrase the was on the card 14 prior to its being shredded. If the second player is able to determine the shredded image or phrase, the second player may advance the number of spaces 28 previously determined. If not, the second player remains at the space where the second player is presently located. Once the timer 20 expires, the second player's turn is over and play moves to a third player, or alternatively, back to the first player. Play continues in this manner until a player reaches the last space on the board 12. The player that first reaches the last space on the board 12 is the winner.

For all methods of play, during the course of play, a player may encounter an element space on the board 12. An element space will contain a consequential action that a player must take if the player encounters the element space. It is preferred that an element space require that a player move forward or backward a number of spaces 28 depending on the content of the elemental space. For example, an element indicator may be that a dog ate the player's homework, therefore, the player must move backward two spaces 28.

The game 10 of the present invention will be appealing to children of varying ages. It engages children's fascination with mechanical gadgets by including a shredding device 40, but also appeals to a child's sense of whimsy by having the shredding device 40 designed as a stylized version of a dog. In addition, the game 10 includes mind engaging puzzle aspects that are enjoyable for varying ages. Further, the game 10 includes some playing features that are determined by skill, e.g., whether or not the player figures out the shredded image or phrase, and some that are determined by chance, e.g., the number the spinner 18 lands on and whether the player will encounter an element indicator. The combination of playing features will be appealing to children of all ages and developmental levels.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A method of playing a game, comprising the steps of:

(a) providing pieces for playing the game, said game pieces including a board having a predetermined number of spaces thereon; a random number generator; a collection of playing cards, each card having an image or phrase located thereon; a shredding device and a timer;

(b) determining a first player to start the game;

(c) determining a number of spaces the first player will be eligible to move;

(d) a second player choosing a playing card from the collection of cards;

(e) the second player placing the chosen card face down into the shredding device;

(f) removing shredded card pieces from the shredding device;

(g) after the shredded card pieces are removed from the shredding device, starting the timer;

(h) the first player by rearranging shredded pieces, attempting to determine the image or phrase that was on the card prior to its being shredded in the allotted time;

(i) if the first player correctly identifies the image or phrase, the first player moving forward the number of determined spaces;

(j) the second player repeating steps (c)-(i), with another player assisting, and (k) repeating steps (c)-(i) for each player in the game until a player reaches a last space on the game board.

2. The method of claim 1, wherein a player is a single person.

3. The method of claim 1, wherein a player is a team of people.

4. The method of claim 1, wherein determining a first player to start the game is done by each player of a plurality of players utilizing a random number generator to determine which player is the first player.

5. The method of claim 1, wherein determining a number of spaces the first player will be eligible to move is done by a first player utilizing a random number generator.

6. The method of claim 5, wherein the random number generator is a spinner having numbers increasing sequentially disposed thereon.

7. The method of claim 5, wherein the random number generator is a spinner having two levels of action indicators disposed thereon.

8. The method of claim 7, wherein a first level of action indicators includes numbers increasing sequentially.

9. The method of claim 7, wherein the second level of action indicators includes color coding.

10. The method of claim 7, wherein the second level of action indicators includes letters arranged alphabetically.

11. The method of claim 1, wherein steps (c) and (d) are combined into one step and the number of spaces the first player will be eligible to move is determined by a number disposed on a second side of the selected playing card.

12. The method of claim 1, wherein the collection of playing cards includes cards having images and phrases of a uniform difficulty level.

13. The method of claim 1, wherein the collection of playing cards includes cards having images and phrase of multiple difficulty levels.

14. The method of claim 1, wherein the collection of playing cards is a plurality of stacks of playing cards, with each stack of the plurality of stacks of playing cards being assigned a predetermined difficulty level and each card within a particular stack having an image or phrase commensurate with the difficulty level of that particular stack.

15. The method of claim 14, wherein the plurality of stacks of playing cards is three stacks, the three stacks signifying low, intermediate and challenging difficulty levels.

16. The method of claim 1, wherein the timer is a sand timer.

17. The method of claim 1, wherein the shredding device is shaped as a stylized depiction of an animal.

18. The method of claim 17, wherein the shredding device is shaped as a stylized depiction of a dog.

19. The method of claim 1, wherein the game board includes a plurality of element spaces having information associated there with, said element spaces being disposed on the game board, whereby if a player encounters an element space during game play, the player may have to move forward or backward on the game board depending on the information associated with said element space.

* * * * *